US010525763B2

(12) United States Patent
Brendle

(10) Patent No.: US 10,525,763 B2
(45) Date of Patent: Jan. 7, 2020

(54) FLAT FOIL PRINTING PRESS HAVING FOIL WEB AND SHEET GUIDANCE

(71) Applicant: Gietz AG, Gossau (CH)

(72) Inventor: Marc Günther Brendle, Gossau (CH)

(73) Assignee: Gietz AG, Gossau (CH)

( * ) Notice: Subject to any disclaimer, the term of this patent is extended or adjusted under 35 U.S.C. 154(b) by 53 days.

(21) Appl. No.: 15/527,658

(22) PCT Filed: Dec. 2, 2015

(86) PCT No.: PCT/CH2015/000177
§ 371 (c)(1),
(2) Date: May 30, 2017

(87) PCT Pub. No.: WO2016/086325
PCT Pub. Date: Jun. 9, 2016

(65) Prior Publication Data

US 2017/0361641 A1 Dec. 21, 2017

(30) Foreign Application Priority Data

Dec. 4, 2014 (CH) ..... 01882/14

(51) Int. Cl.
*B41F 19/00* (2006.01)
*B41F 19/06* (2006.01)
(Continued)

(52) U.S. Cl.
CPC ..... *B44B 5/022* (2013.01); *B41F 19/02* (2013.01); *B42D 25/328* (2014.10);
(Continued)

(58) Field of Classification Search
CPC ..... B44B 5/022; B44B 5/0052; B44B 5/0071; B42D 25/328; B42D 25/425; B41F 19/02; B41F 19/06
See application file for complete search history.

(56) References Cited

U.S. PATENT DOCUMENTS 4,266,925 A * 5/1981 Book ..... B25B 11/005 425/387.1
5,746,122 A * 5/1998 Gietz ..... B30B 15/0041 100/257
(Continued)

FOREIGN PATENT DOCUMENTS

EP 0858888 A2 8/1998
WO 2008/028309 A1 3/2008
WO 2009/143644 12/2009

OTHER PUBLICATIONS

International Search Report for PCT/CH2015/000177, dated Jan. 25, 2016.
(Continued)

*Primary Examiner* — Matthew G Marini
*Assistant Examiner* — Marissa Ferguson-Samreth
(74) *Attorney, Agent, or Firm* — Oppedahl Patent Law Firm LLC

(57) ABSTRACT

The flat foil printing press comprises an evacuable back-pressure plate (9), with suction regions (15*k*) which run in the sheet running direction (X) and which are next to embossing regions (16*k*), in which foil webs (6*k*) run. The suction regions are subdivided into several suction segments (10*i*) which are successive in the sheet running direction, and are each connected to a vacuum source (14) by way of a vacuum feed line (12*i*) via a vacuum switching element (13*i*). With the running-out of an embossed sheet (5), firstly all suction segments (10*i*) covered by the sheet are evacuated, and subsequently the suction segments which are no longer covered by the sheet are successively disconnected from the vacuum source. This results in an error-free separation of foil webs and sheets, for a greater picture quality and machine output.

13 Claims, 9 Drawing Sheets

Figure 1:
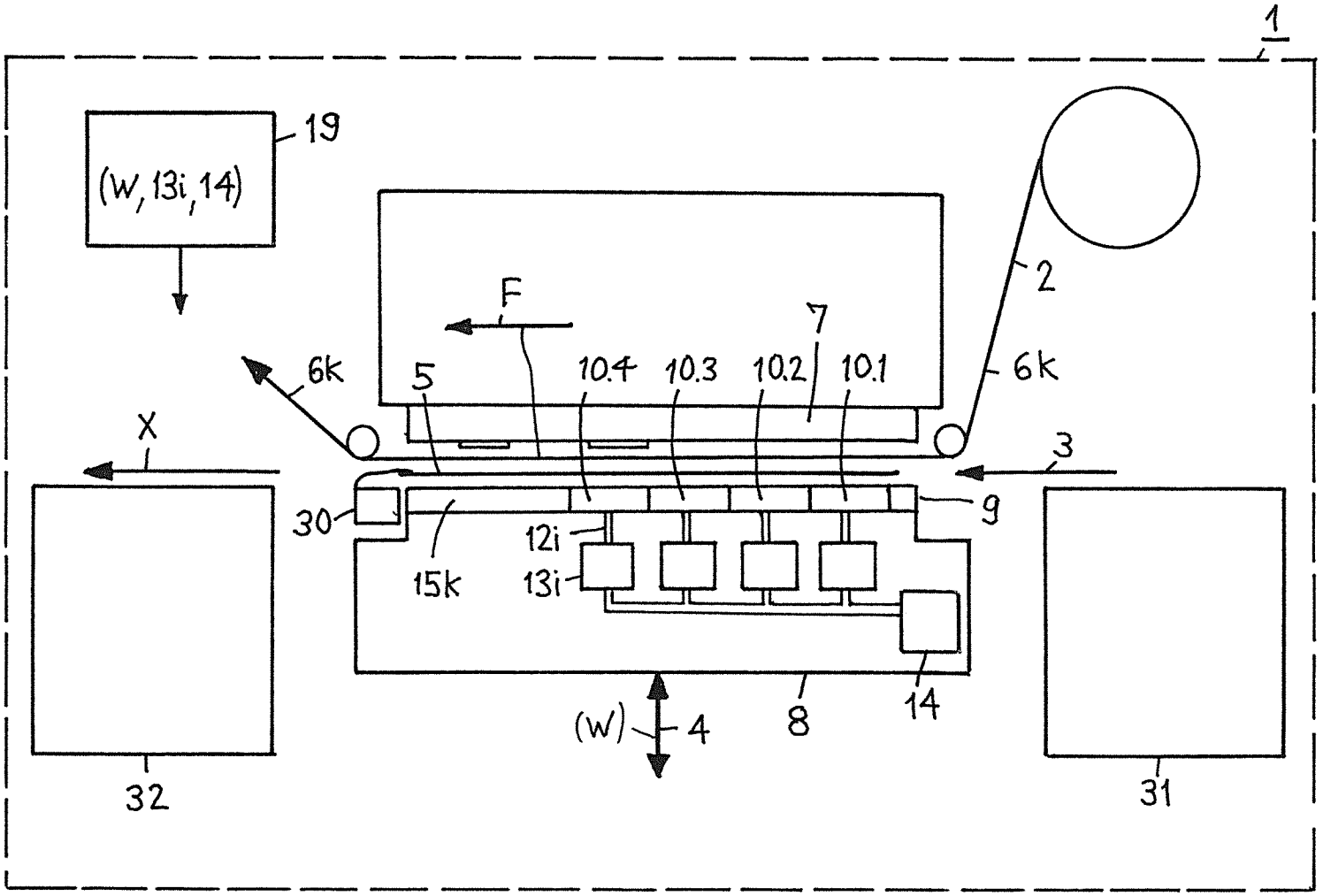

(51) Int. Cl.

| | |
|---|---|
| ***B44B 5/02*** | (2006.01) |
| ***B44B 5/00*** | (2006.01) |
| ***B42D 25/328*** | (2014.01) |
| ***B42D 25/425*** | (2014.01) |
| ***B41F 19/02*** | (2006.01) |

(52) U.S. Cl.
CPC ..... *B42D 25/425* (2014.10); *B44B 5/0052* (2013.01); *B44B 5/0071* (2013.01)

(56) References Cited

U.S. PATENT DOCUMENTS

| | | | | |
|---|---|---|---|---|
| 5,979,308 | A * | 11/1999 | Kagi | B41F 19/068 101/27 |
| 2004/0119119 | A1* | 6/2004 | Chang | H01L 27/0255 257/355 |
| 2005/0247406 | A1* | 11/2005 | Kagi | B41F 19/068 156/494 |
| 2010/0148428 | A1* | 6/2010 | Kagi | B65H 5/085 271/227 |
| 2011/0265671 | A1* | 11/2011 | Brendle | B65H 23/10 101/22 |
| 2018/0229543 | A1* | 8/2018 | Banziger | B44B 5/028 |

OTHER PUBLICATIONS

English Translation of the Written Opinion of the International Searching Authority for PCT/CH2015/000177, dated Jan. 25, 2016.
International Preliminary Report on Patentability for PCT/CH2015/000177, dated Jun. 6, 2017.

* cited by examiner

FLAT FOIL PRINTING PRESS HAVING FOIL WEB AND SHEET GUIDANCE

The invention relates to a flat foil printing press with a foil web guidance for several foil webs and with a sheet guidance, according to the preamble of claim 1. Particularly high printing outputs of the best quality and also for demanding printing tasks can be carried out with such flat foil printing presses. These flat foil printing presses on the one hand place particularly high demands upon the guidance and the precise feeding of thin, narrow and very sensitive embossing printing foil webs and on the other hand upon the precise guidance and positioning of the sheets. Thereby, several foil webs need to be guided and conveyed simultaneously in a perfectly flat manner and the foil guidance needs to be effected in a perfectly plane, flat and correctly positioned manner, without deformation, arching, creases and dislocations. The guidance of the sheets must likewise be effected in this manner, in order to be able to achieve high outputs and picture qualities. Such flat foil printing presses are known e.g. from EP 1 593 503 and WO 2009/143644.

Not only must an optimal, error-free positioning of foil webs and sheets be achieved, but above all also after the embossing, a gentle and perfect separation of the foil webs from the sheet with the continued transport, for demanding picture embossing tasks, in particular for hologram embossing with picture security features, e.g. for tickets, identity documents or banknotes, in the case of several picture foil webs over the whole printing table.

Here however, large problems still result with the increasing demands on the output and picture quality.

According to EP 0 739 722 for example, a blower producing a laminar airflow counter to the sheet running direction and between sheet and the foil webs is applied at the outlet of the flat press, for keeping the sheet flat and level in the printing station. This however is no longer sufficient for more demanding tasks, specifically for narrow foil webs (e.g. only 10 mm wide) and for thin paper sheets. Given a poor detachment of the foil webs which remain stuck to the sheet, on the one hand the foils webs become deformed, overstretched and damaged and on the other hand the sheet also becomes deformed, uneven and warped and creases can form, to the extent that faulty and completely unusable individual pictures subsequently arise on cutting the sheets to size into individual pictures—just as in the case of deformed foil webs.

It is therefore the object of the present invention to provide a better and more precise foil web guidance and sheet guidance for flat foil printing presses, with a significantly improved separation of foils webs and sheets after the embossing, and thus to provide an error-free, level guidance of foil webs and sheets after the embossing, so that the sheets remained unchanged in their level and flat state and the foils webs are not overstretched and damaged.

According to the invention, this object is achieved by a flat foil printing press with a foil web guidance and with a sheet guidance, by way of an evacuated or evacuable back-pressure plate, according to claim 1, by a back-pressure plate with integrated suction regions which run in the sheet running direction and which are next to and between the embossing regions, in which the foil webs run, wherein the suction regions are each subdivided into several suction segments which are successive in the sheet running direction and wherein the suction segments each comprise a switchable vacuum feed line from a vacuum source, so that after the embossing, all suction segments covered by the sheet are evacuated, and subsequently, with the running-out of the embossed sheet, the suction segments which are no longer covered by the sheet are successively disconnectable from the vacuum source.

Figure 2:
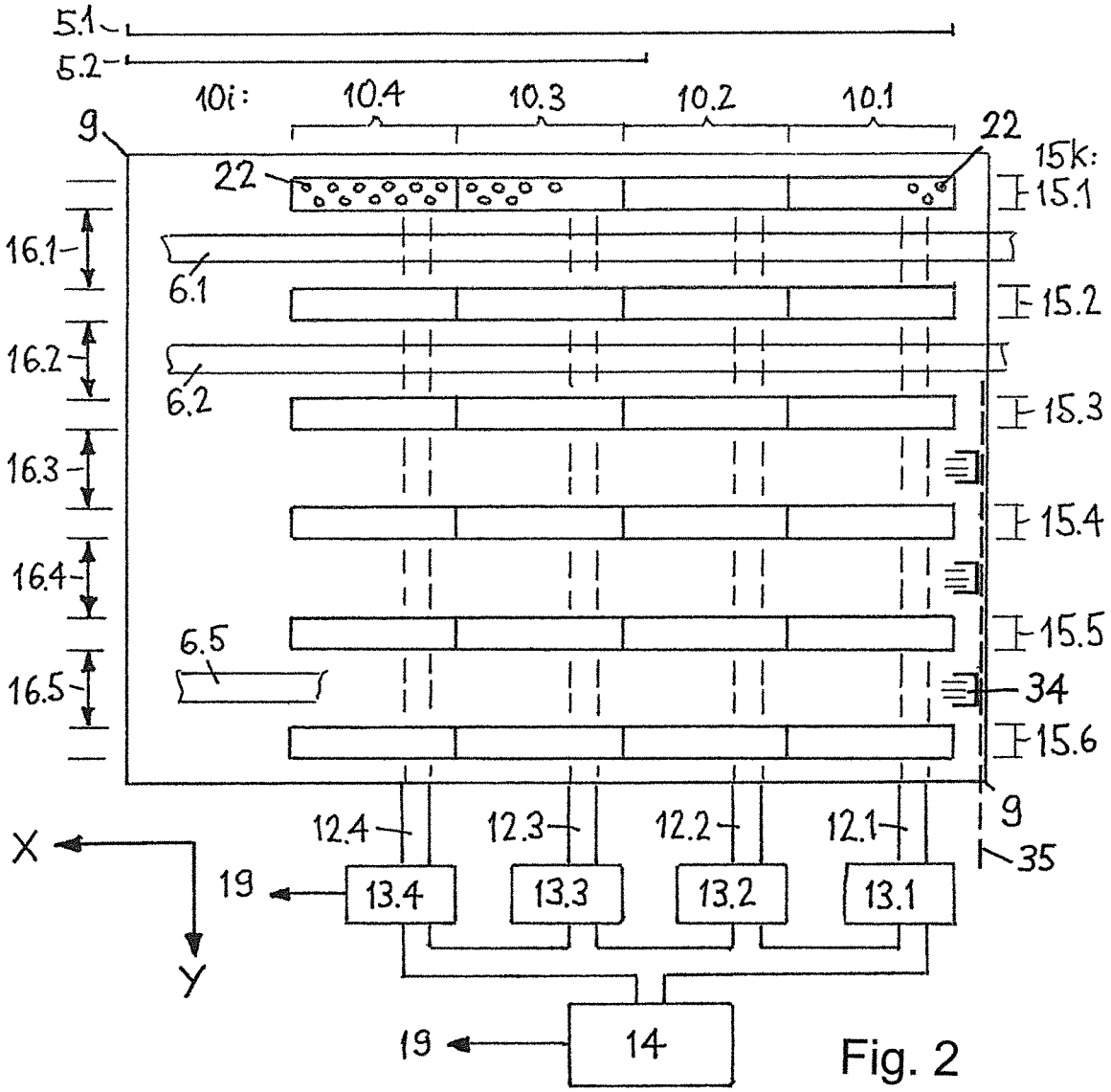
Figure 3:
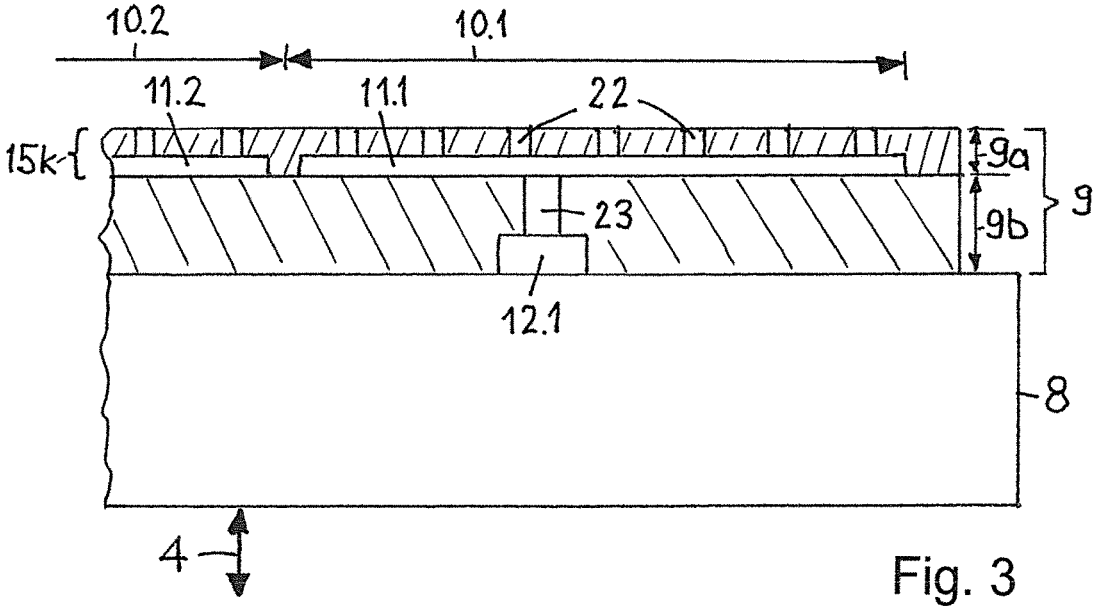
Figure 4A:
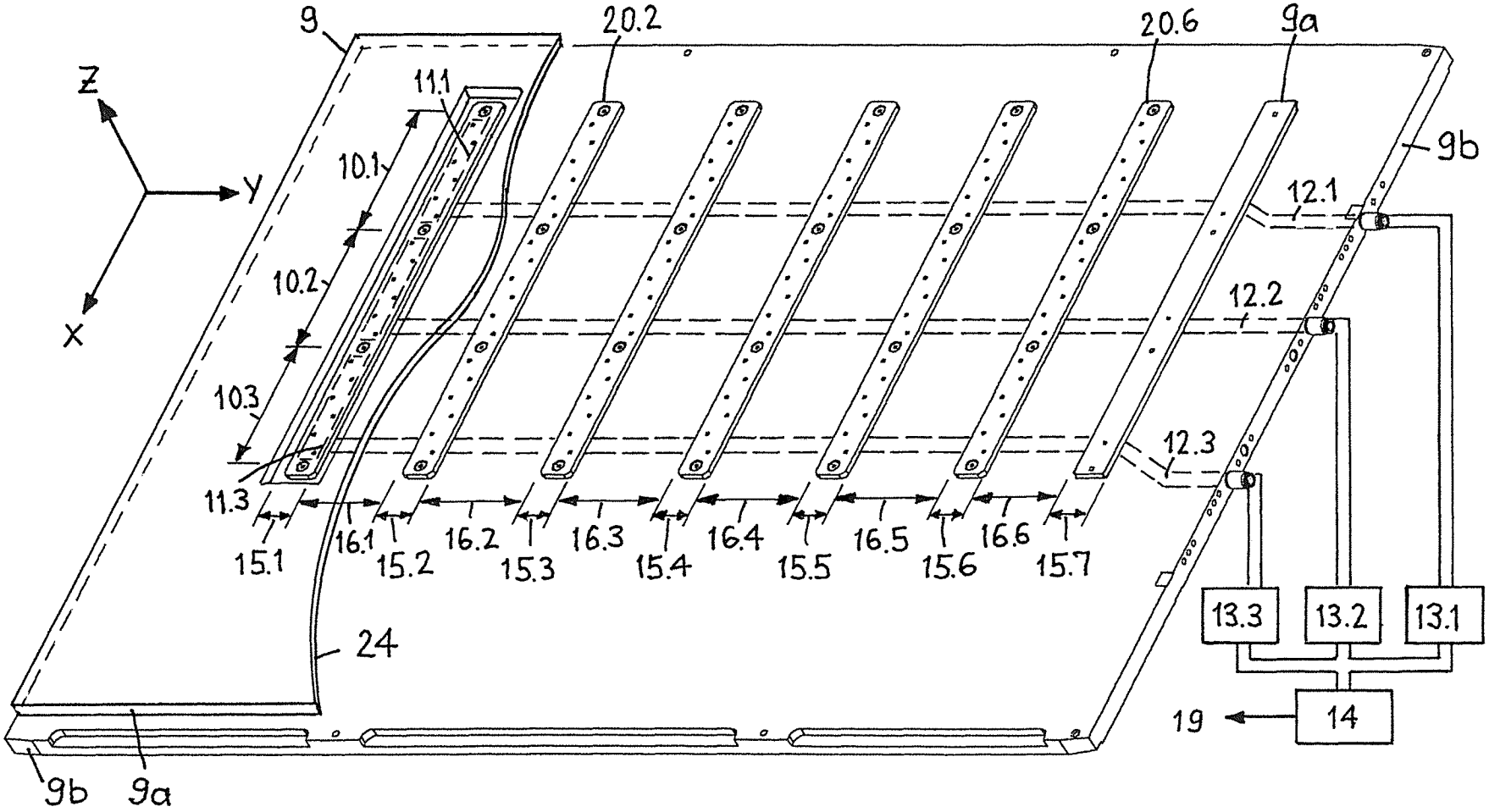
Figure 4B:
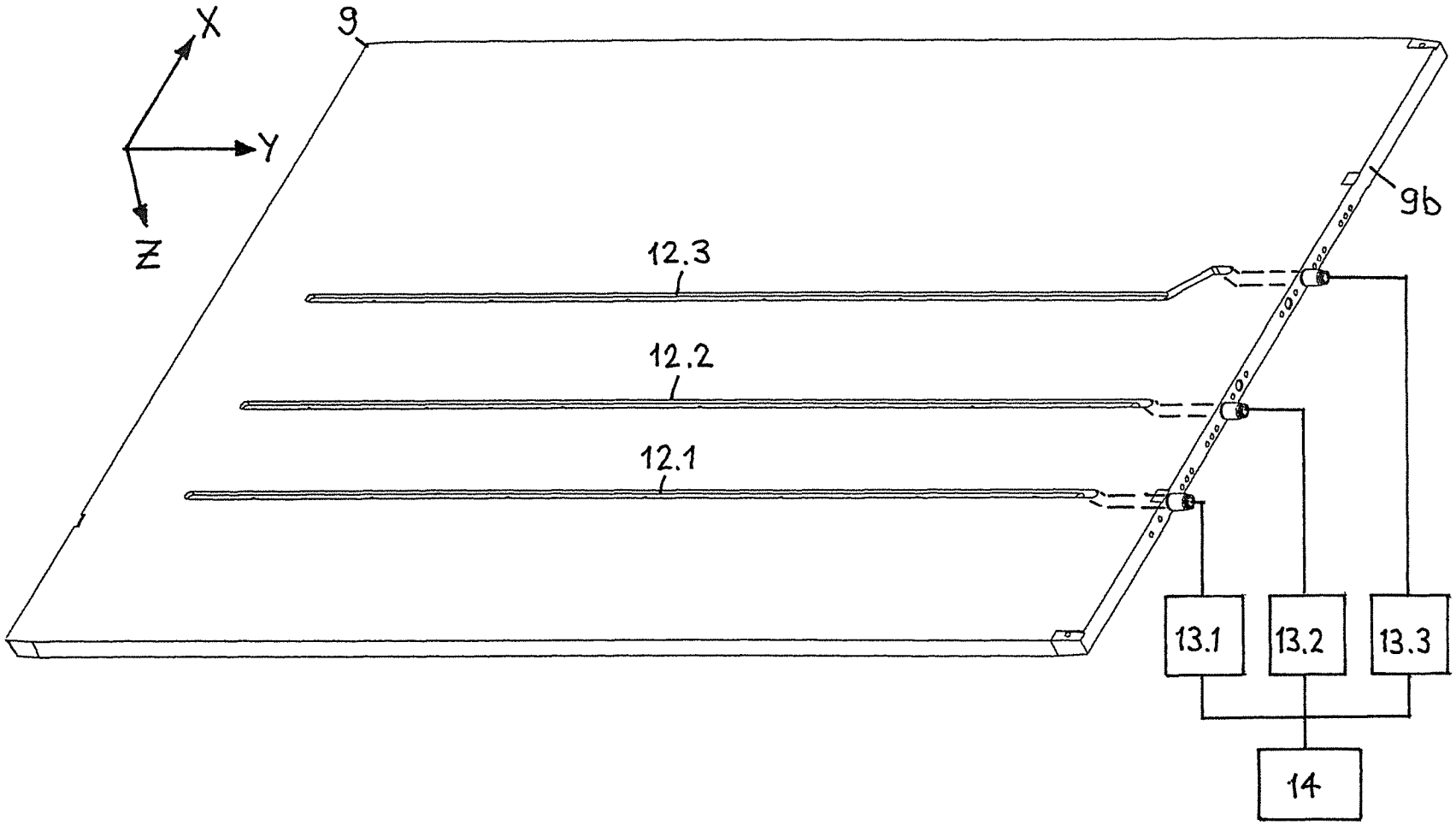
Figure 5A:
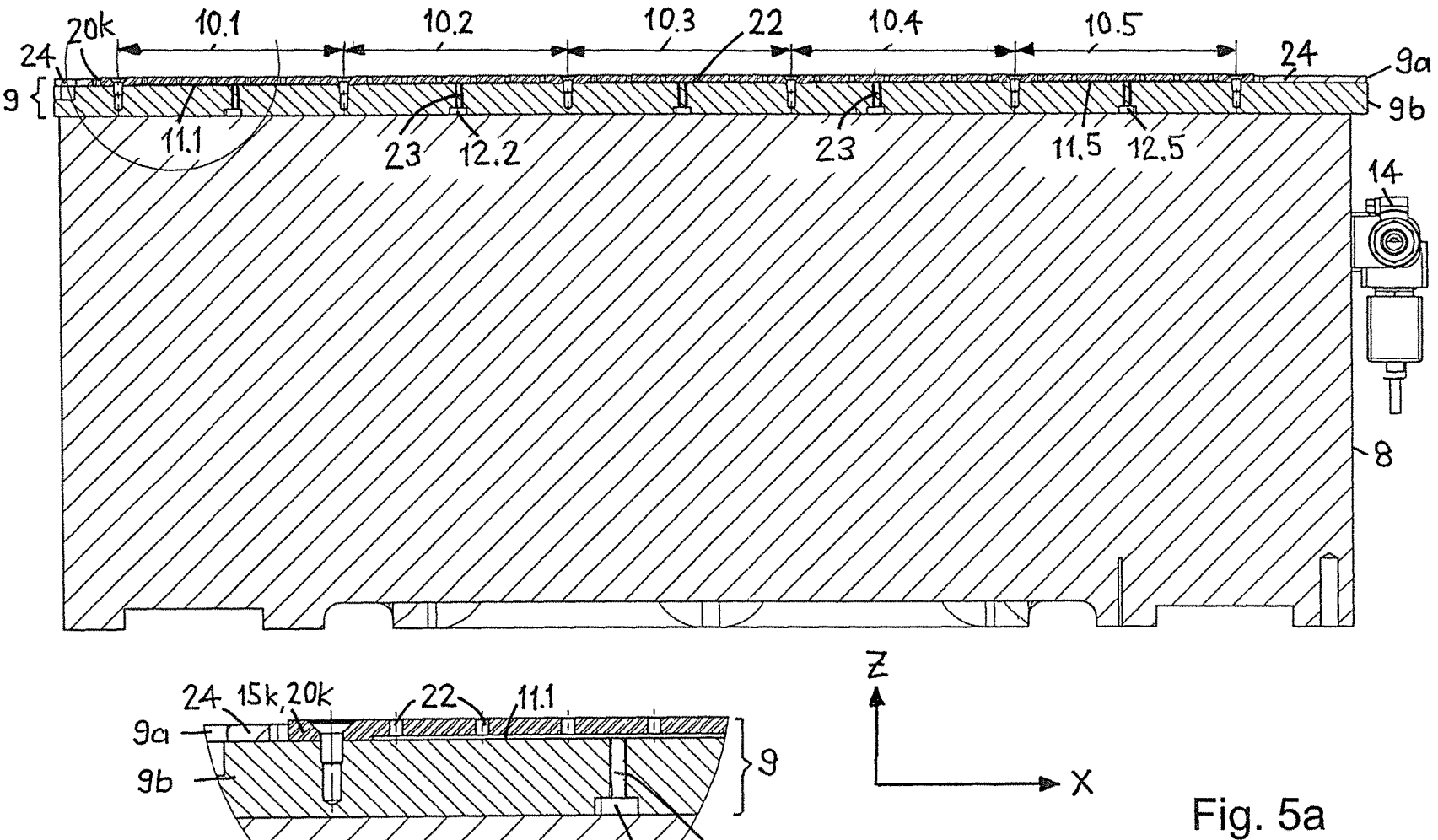
Figure 5B:
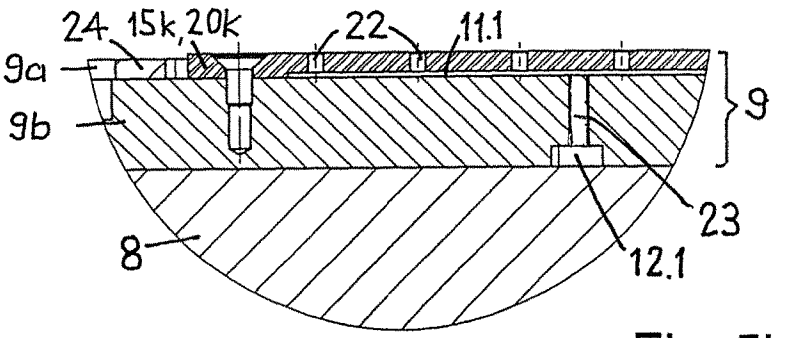
Figure 6:
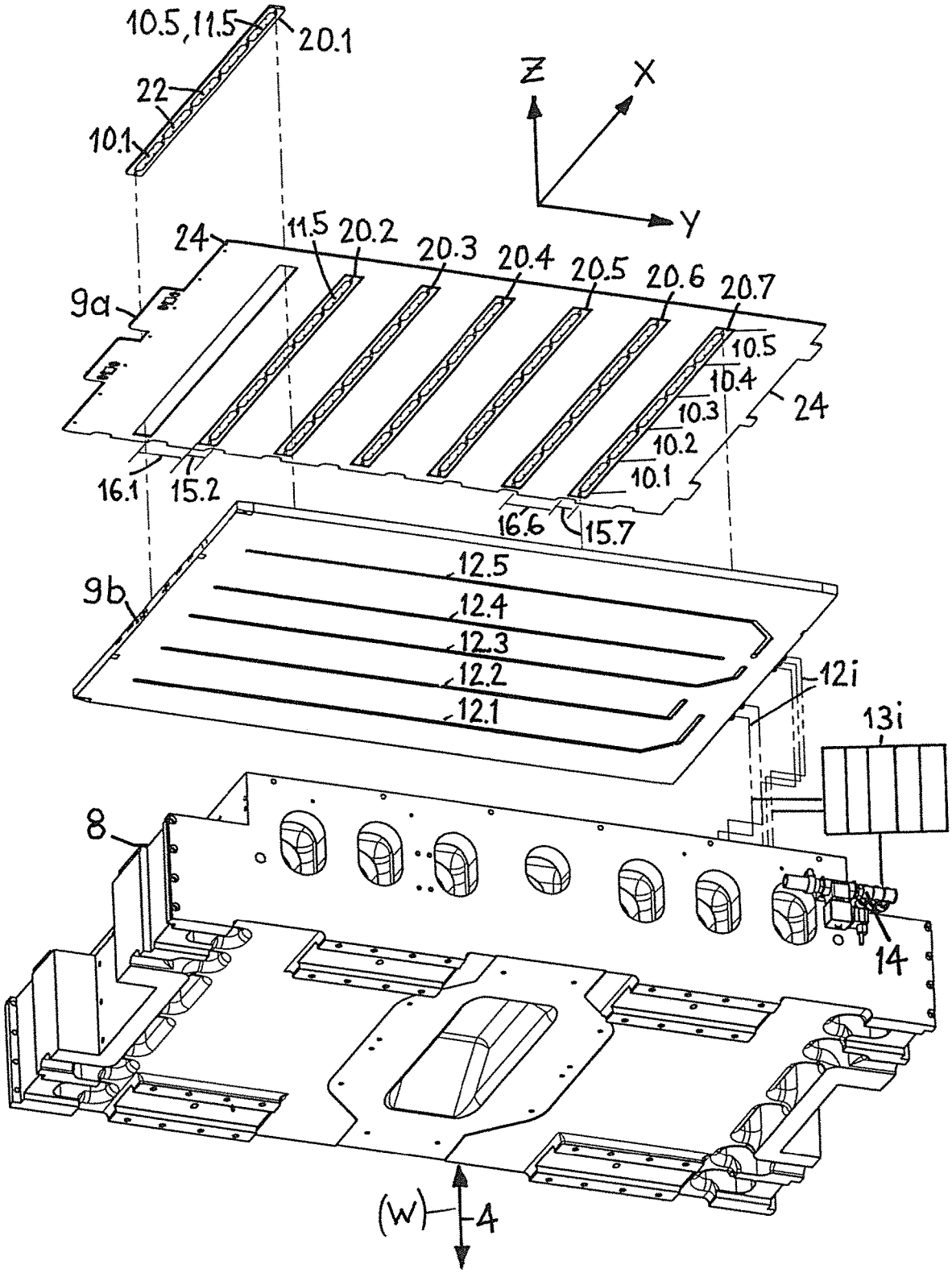
Figure 7:
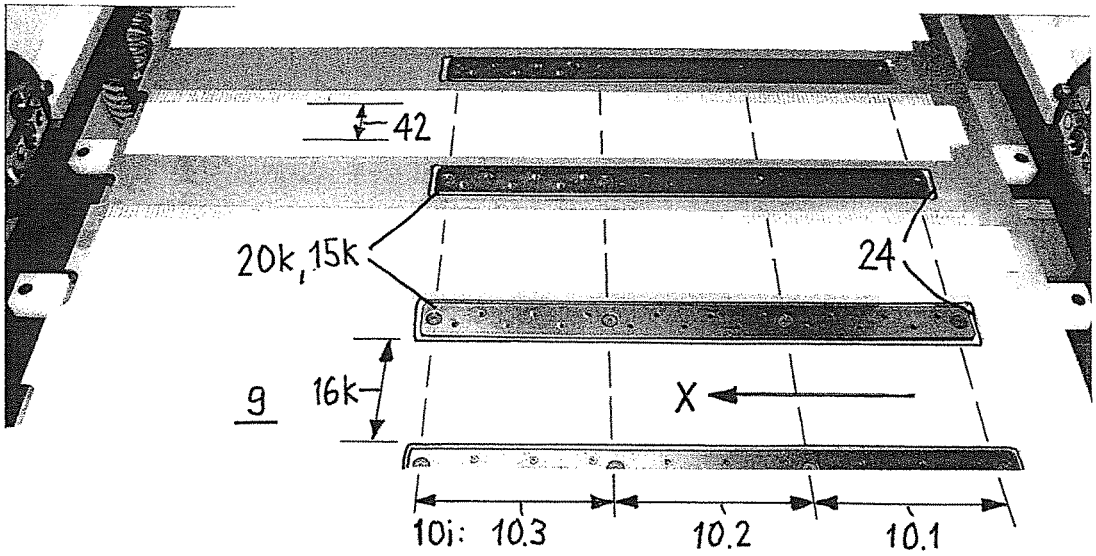
Figure 8A:
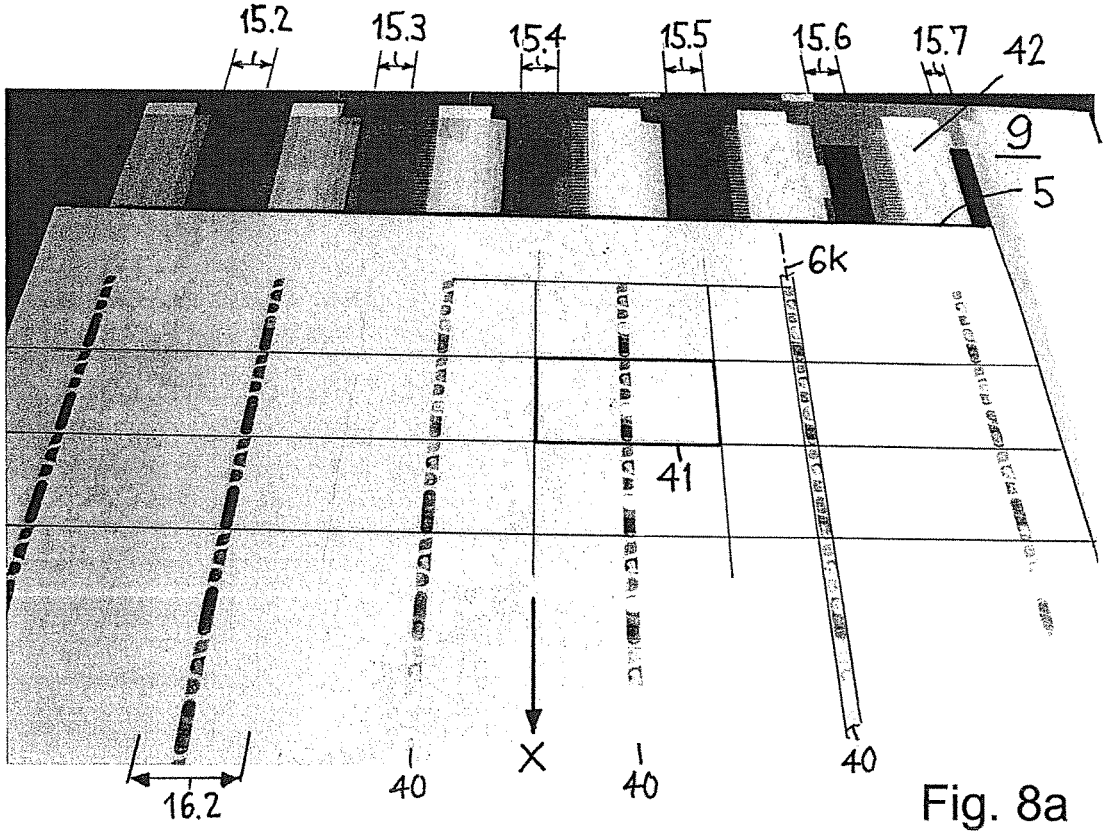
Figure 9B:
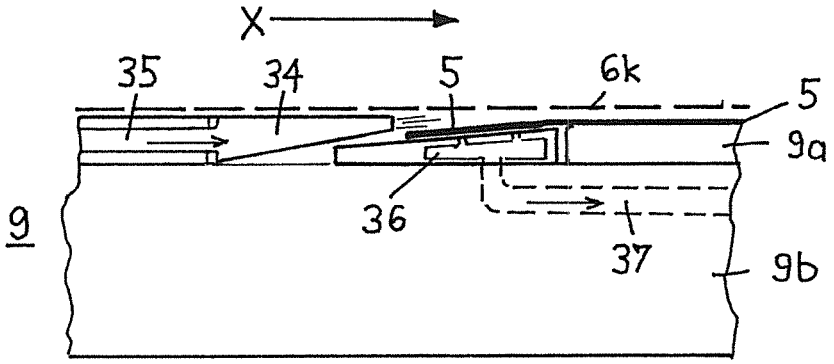
Figure 9A:
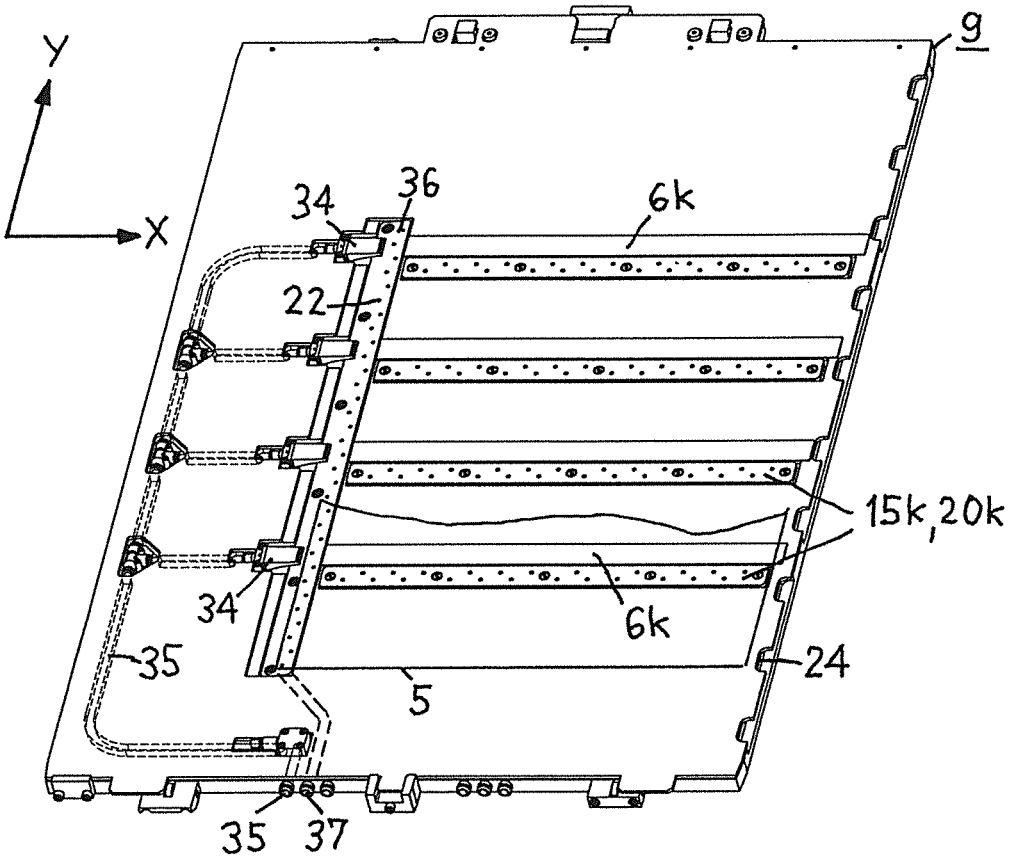

The dependent claims relate to advantageous further developments of the invention with further improvements of the sheet guidance, of the back-pressure plate and of the foil web detachment and thus also of the machine output and picture quality. The invention is hereinafter explained in more detail by way of examples and figures. There are shown in:

FIG. 1 schematically, an evacuable flat foil printing press according to the invention, with a foil web guidance and with a sheet guidance, with a back-pressure plate which comprises suction regions with several suction segments, vacuum feed lines and a vacuum source;

FIG. 2 schematically, a back-pressure plate with suction regions which are subdivided into several suction segments and which are arranged next to the embossing regions;

FIG. 3 a back-pressure plate with an upper plate which comprises vacuum chambers with suction openings and with a lower plate with vacuum feed lines;

FIG. 4*a* seen from above, a back-pressure plate with three suction segments, with suction strips, support mask, vacuum feed lines and vacuum switching elements;

FIG. 4*b* the lower plate of the back-pressure plate, seen from below with vacuum feed lines to the vacuum switching elements;

FIG. 5*a*, 5*b* a back-pressure plate in the longitudinal section through a suction strip of a suction region with five suction segments and with vacuum chambers in an upper plate and with vacuum feed lines in a lower plate;

FIG. 6 the construction of the example of FIG. 5 with suction strips in seven suction regions with six embossing regions, with suction strips with five suction segments and with a support mask forming embossing regions, in an upper plate and with five vacuum feed lines in a lower plate, as well as a printing table as a support face;

FIG. 7 a view of a back-pressure plate with suction strips, a surrounding support mask and with a make up in the embossing regions;

FIG. 8*a, b* in the example of FIG. 7, an embossed sheet with foil pictures which is applied onto the back-pressure plate, corresponding to the course of the foil webs;

FIG. 9*a,b* a back-pressure plate with additional separation air nozzles at the inlet side and with a suction region in the transverse direction.

FIG. 1 shows a flat foil printing press 1 according to the invention, with a foil web guidance 2 for several foil webs 6*k* and with a sheet guidance 3 which by way of gripper bars 30 moves sheets 5 from a feeder 31 onto the embossing location on a back-pressure plate 9 of a flat bed press 4 with a printing and tool plate 7 and moves them further onto a delivery means 32 after the embossing procedure.

The back-pressure plate 9 is evacuable and comprises suction regions 15*k* which run in the sheet running direction X and which have suction openings 22. These suction regions are arranged next to and between embossing regions 16*k*, in which the foil webs 6*k* run (→FIG. 2). The suction regions 15*k* are subdivided into several suction segments 10*i* which are successive to one another in the sheet running direction X, wherein the suction segments are each connected to a vacuum source 14 via a vacuum switching element 13*i* by way of a vacuum feed line 12*i* and controlled, in a manner such that given a standstill of the embossed sheet 5, firstly all suction segments 10*i* covered by the sheet are evacuated (by which means the sheet is pressed onto the back-pressure plate 9) and subsequently, with the running-out of the embossed sheet 5, the suction segments 10*i* which are no longer covered by the sheet are successively disconnectable from the vacuum source 14 (and these suction segments are thus no longer evacuated). With the running-out of the sheet, above all it is also its rear end which is held back by the vacuum in the suction segments, and the sheet is stretched by way of this, so that even thin paper sheets can be kept flat and no creases can form.

The example of FIG. 1 comprises four suction segments 10.1-10.4 and accordingly also four vacuum feed lines 12.*i*=12.1-12.4 and four vacuum switching elements 13.*i*=13.1-13.4. At least two suction segments 10*i* are provided, preferably also more, e.g. three to five suction segments, depending on the application.

The vacuum source 14 and its power can also be set or switched on and off by way of a machine control 19.

A mechanical vacuum pump with a switching valve can be applied as a vacuum source 14 or preferably also a rapidly switchable injector pump. The vacuum in the suction regions 15*k* can be switched on with this, preferably given a standstill of the sheet 5, and can be switched off after the last suction segment 10*i* is no longer covered by the running-out sheet.

The example of FIG. 1 shows a flat foil printing press with a sheet running direction X and a foil web running direction F which are the same. The lowering of the back-pressure plate begins after the embossing and, in a settable manner, shortly thereafter the initial drawing of the foil webs 6*k* and of the sheet 5. The inventive, evacuable back-pressure plate 9 can likewise also be applied in flat foil printing presses with sheet running directions and foil web running directions which are counter to one another.

FIG. 2 schematically shows a back-pressure plate 9 with five embossing regions 16*k*=16.1-16.5, in which the foil webs 6.1-6.5 run, and with six suction regions 15*k*=15.1-15.6 next to and between the embossing regions. As FIG. 1 shows, this example shows four suction segments 10*i*=10.1-10.4 which, departing from the sheet end, extend past the middle of the back-pressure plate 9.

Here, a longer, larger sheet 5.1 covers all suction segments 10.1-10.4, whereas a shorter, smaller sheet 5.2 e.g. now merely covers the suction segments 10.3 and 10.4. The suction segments 10.1 and 10.2 can then be disconnected or covered. For embossing a narrower sheet—e.g. with suction regions 15.1 and 15.6 which are not covered—these can be covered or disconnected.

The suction segments 10*i* are connected to the vacuum source 14 via the feed lines 12*i* and the vacuum switching elements 13*i*.

Vacuum suction valves can preferably be applied as vacuum switching elements 13*i* in the vacuum feed lines 12*i*.

However, vacuum switching valves can also be applied.

Vacuum suction valves are self-controlling. When the suction openings 22 of a suction segment 10*i* are covered (closed) by a sheet 5, then the vacuum suction valve opens and a vacuum arises in the corresponding suction segment. The vacuum suction valve closes again when the suction segment is no longer covered by a sheet. The vacuum is therefore retained in the suction segments which are still covered.

Controlled vacuum switching valves can hence be opened and closed by way of the machine control 19 according to adjustable/settable machine rotation angles W, so that the suction segments 10*i* are evacuated at the desired times.

As a further example, FIG. 3 shows a part of a back-pressure plate 9 which is at the run-in side, wherein in each suction segment 10*i*, the back-pressure plate comprises a vacuum chamber 11*i* with suction openings 22 and with a connection opening 23 to the respective vacuum feed line 12*i*.

The back-pressure plate 9 here is divided into an upper plate 9*a* and a lower plate 9*b*. In each suction segment 10*i*, the upper plate 9*a* comprises vacuum chambers 11*i* with suction openings 22, and the separate lower plate 9*b* comprises vacuum feed lines 12*i* with a connection opening 23 to each vacuum chamber 11*i*. This division into an upper and a lower plate permits a simple manufacture of the evacuable back-pressure plate 9 according to the invention, said plate lying on the printing table 8.

FIG. 4*a*, 4*b* show a further advantageous embodiment variant of the back-pressure plate 9. According to FIG. 4*a*, in the suction regions 15*k*, here an upper plate 9*a* comprises suction strips 20*k* which comprise vacuum chambers 11*i* and suction openings 22, as well as a support mask 24 which surrounds the suction strips 20 in the embossing regions 16*k*.

Adjustable suction strips 20*k* which can be screwed on and which can be displaced according to a changed arrangement (layout) of foil webs 6*k* or of embossing regions 16*k* are also particularly advantageous. The support mask 24 here is also accordingly adapted or exchanged.

FIG. 4*b* shows the lower plate 9*b* seen from below, with the vacuum feed lines 12*i*=12.1-12.3, here visible as open channels which lie on the surfaces of the printing table 8 (shown in FIG. 5*a* and FIG. 6) and are coved by this surface and which are connected to the vacuum chambers 11*i* by way of connection openings 23. FIG. 4*a*, 4*b* represents an example with seven suction regions 15*k*=15.1-15.7 and with three suction segments 10*i*=10.1-10.3 and with just as many vacuum feed lines 12*i* and vacuum switching elements 13*i*.

FIGS. 5*a*, 5*b* in a cross section through a suction region 15*k* show a further example with suction strips 20*k*, with suction chambers 11*i* and with a surrounding support mask 24 as an upper plate 9*a*, here with five suction segments 10*i*=10.1-10.5, and with vacuum feed lines 12*i* as well as connection openings 23 in the lower plate 9*b*.

FIG. 5*b* shows an enlarged detail of FIG. 5*a*.

The surface of the suction regions 15*k* or of the suction strips 20*k* can advantageously have an increased adhesion to the sheets 5. For this, their surface can be designed more roughly than in the embossing regions 16*k*, or the surface can comprise a rubber coating.

Figure 8B:
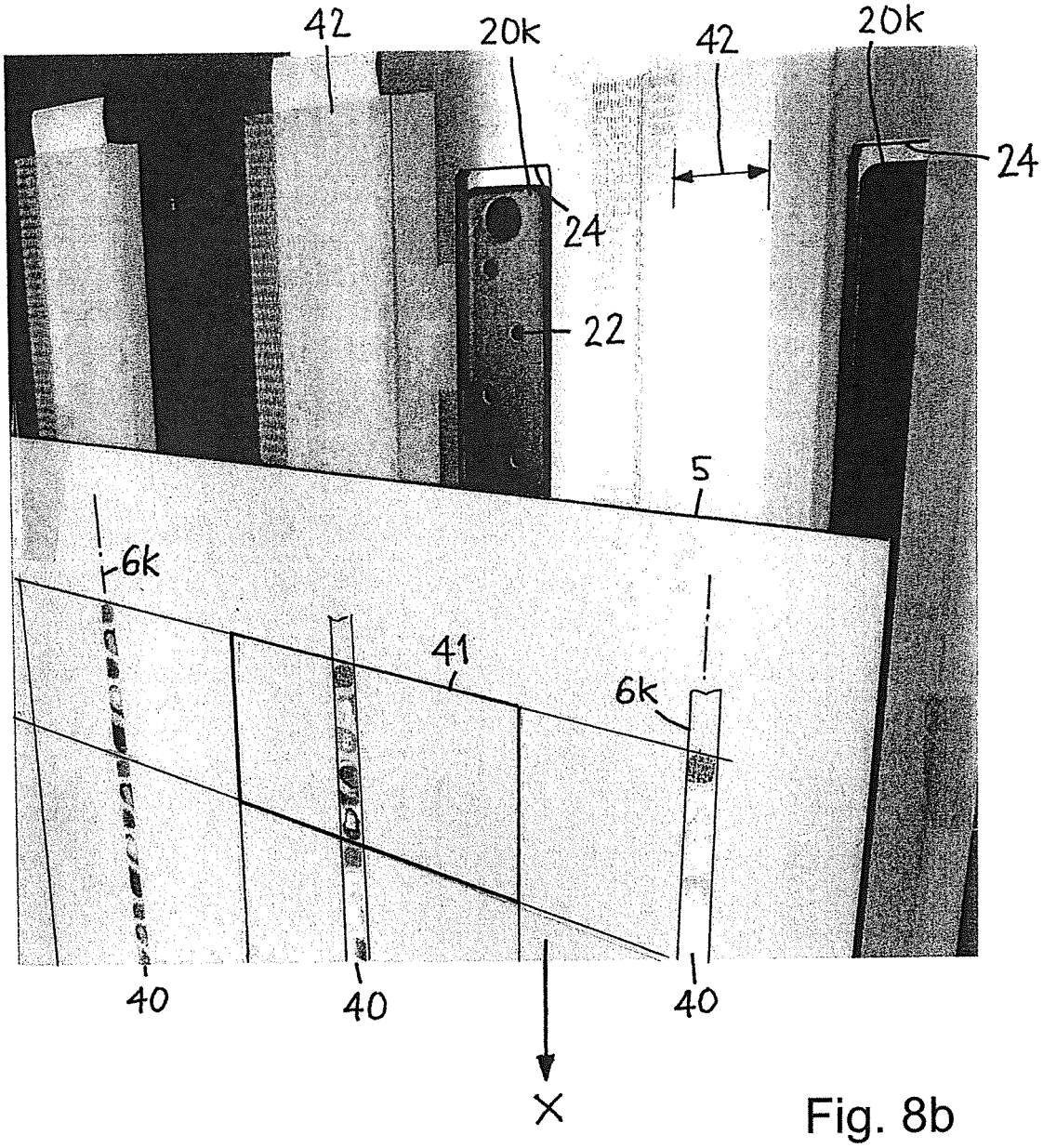

FIG. 6 illustrates the construction of the example of FIG. 5. The lower plate 9*b* with the five vacuum feed lines 12.1-12.5 which are connected to the five vacuum switching elements 13*i* and to the vacuum source 14 lies on the printing table 8. The upper plate 9*a* with the five suction segments 10.1-10.5 each in the seven suction strips 20*k*=20.1-20.7 which form the suction regions 15*k* and with the support mask 24 lies on this lower plate FIGS. 7 and 8 show views of a back-pressure plate 9 with six embossing regions 16*k*=16.1-16.6 and seven suction regions 15*k*=15.1-15.7 and with suction strips 20*k* which comprise three suction segments 10*i*=10.1-10.3, and with a corresponding support mask 24. Here, make ups 42 are evident on the support mask 24, in the embossing regions 16*k*.

FIG. 8*a, b* show a sheet 5 which is embossed by way of six foil webs 6*k*, with foil pictures 40 as picture strips, said sheet having been applied onto the back-pressure plate 9 in accordance with the course of the foil webs. As to how the finished, printed and embossed sheet is cut to size into individual pictures 41 is also indicated on this sheet. An identical picture from the picture strip 40 must then be present on each individual picture 41 at the same location (specifically in quality and security printing—e.g. for tickets and banknotes).

This illustrates that an error-free, secure detachment of the foil webs from the sheet after the embossing, without any warping, squashing and dislocation on the part of the foil webs and the sheet is an absolute precondition for challenging embossing tasks and error-free, registered pictures of the highest quality.

On detachment, the foil web tension and the suction force of the vacuum in the suction segments upon the sheet can also be matched to one another for this.

FIG. 9*a, b* show a further example of an evacuable back-pressure plate 9 with additional separation air nozzles 34 beneath the foil webs 6*k* and with an additional suction region 36 running in the transverse direction Y. The separation air nozzles 34 with compressed air feed lines 35, at the inlet side, are attached to the back-pressure plate directly behind the sheet 5 and below the foil webs 6*k*, and the suction region 36 with a vacuum feed line 37 is arranged below the rear edge of the sheet 5. After the embossing, the rear sheet end is pressed onto the back-pressure plate 9 by way of evacuation, and compressed air is blown between the foil webs 6*k* and the sheet 5 with the subsequent lowering of the back-pressure plate, so that the separation of foil webs and sheet is significantly improved here.

The suction region 36 can also comprise a suction strip, analogously to the suction regions 15*k* in the longitudinal direction.

FIG. 9*a* perspectively shows the back-pressure plate and FIG. 9*b* schematically shows a cross section through a separation air nozzle 34 and the suction region 36 with the lying-on edge of the sheet 5 beneath a foil web 6*k*. An arrangement of separation air nozzles 34 is also illustrated in FIG. 2.

The vacuum feed lines 11 with the vacuum switching elements 12*i* and the vacuum source 14 as well as their control in the machine control 19 also belong the evacuable back-pressure plate 9 according to the invention.

The back-pressure plate 9 with the vacuum switching elements 12*i* can preferably be designed in an exchangeable manner.

The following reference numerals are used in the scope of this description:

1 flat foil printing press
2 foil web guidance
3 sheet guidance
4 flat bed press
5 sheet
6 foil webs
7 printing plate with tool plate
8 printing table with supporting face for 9
9 back-pressure plate (evacuable)
9*a* upper plate of 9 with 11*i* and 22
9*b* lower plate with 12*i* and 23
10*i* suction segments (in Y-direction)
11, 11*i* vacuum chambers
12, 12*i* vacuum feed lines
13, 13*i* vacuum switching elements
14 vacuum source
15, 15*k* suction regions (in X-direction)
16, 16*k* embossing regions
19 machine control
20, 20*k* suction strips with 11*i* and 22
22 suction openings
23 connection openings (11*i*-12*i*)
24 support mask
30 gripper bar
31 feeder
32 delivery means
34 separation air nozzle, blower on 9
35 compressed air fed line
36 suction region in Y-direction
37 vacuum feed line
40 embossed foil pictures as picture strips on 5
41 cut-to-size singe picture
42 make up
F foil web running direction
W machine rotation angle
X sheet running direction
Y transverse direction
Z vertical direction

The invention claimed is:

1. A flat foil printing press with a foil web guidance for several foil webs and with a sheet guidance, a back-pressure plate and a machine control, characterised by the back-pressure plate comprising an evacuation structure, said evacuation structure comprising suction regions which run in a sheet running direction and which have suction openings, wherein the suction regions are arranged next to and between several embossing regions without suction openings, in which the foil webs run, wherein the suction regions are subdivided into several suction segments which are successive in the sheet running direction and wherein the suction segments are each connected to a vacuum source via a vacuum switching element by way of a vacuum feed line and are controllable by means of a program in the machine control, so that after an embossing, firstly all suction segments covered by a sheet are evacuable, and subsequently, when an embossed sheet runs out, the suction segments which are no longer covered by the sheet are successively disconnectable from the vacuum source.

2. A flat foil printing press according to claim 1, characterised in that the suction regions in each suction segment comprise a vacuum chamber with suction openings and with a connection opening to the corresponding vacuum feed line and to the vacuum switching element.

3. A flat foil printing press according to claim 1, characterised in that vacuum suction valves are provided as vacuum switching elements on the vacuum feed lines.

4. A flat foil printing press according to claim 1, characterised in that controlled vacuum switching valves are provided as vacuum switching elements on the vacuum feed lines.

5. A flat foil printing press according to claim 1, with a control for a switchable and adjustable vacuum source.

6. A flat foil printing press according to claim 1, characterised in that the back-pressure plate comprises an upper plate and a lower plate, wherein the upper plate comprises suction regions, with vacuum chambers and with suction openings in each suction segment, and the lower plate comprises vacuum feed lines with a connection opening to each vacuum chamber.

7. A flat foil printing press according to claim 6, characterised in that the back-pressure plate as an upper plate, in the suction regions, comprises suction strips with vacuum chambers and suction openings, as well as a support mask which surrounds the suction strips.

8. A flat foil printing press according to claim 7, characterised in that the suction strips are adjustable, wherein the support mask is adapted accordingly.

9. A flat foil printing press according to claim 1, characterised in that a vacuum in the suction regions is switched on given a standstill of a sheet and is switched off after a last suction segment is no longer covered by a running-out sheet.

10. A flat foil printing press according to claim 1, characterised in that a surface of the suction regions has an increased adhesion to sheets.

11. A flat foil printing press according to claim 1, characterised in that separation air nozzles with compressed air feed lines which, after an embossing, blow an airflow between the foil webs and a sheet as soon as the back-pressure plate is lowered, are arranged on the back-pressure plate at an inlet side, directly behind the sheet and below the foil webs.

12. A flat foil printing press according to claim 1, characterised in that the back-pressure plate comprises a suction region having a vacuum feed line and running in a transverse direction, at an entry side, below a rear edge of a sheet.

13. A back-pressure plate for a flat foil printing press with a foil web guidance for several foil webs, with a sheet guidance, a back-pressure plate and a machine control, characterised in that the back-pressure plate comprises an evacuation structure, the evacuation structure comprising suction regions which run in a sheet running direction and which have suction openings, wherein the suction regions are arranged next to and between several embossing regions without suction openings, in which the foil webs run, wherein the suction regions are subdivided into several suction segments which are successive in the sheet running direction and wherein the suction segments are each connected to a vacuum source via a vacuum switching element by way of a vacuum feed line and are controllable by means of a program in the machine control, so that after an embossing, firstly all suction segments covered by a sheet are evacuable, and subsequently, when an embossed sheet runs out, the suction segments which are no longer covered by the sheet are successively disconnectable from the vacuum source.

* * * * *